US010821370B2

(12) United States Patent
Pietrobon et al.

(10) Patent No.: US 10,821,370 B2
(45) Date of Patent: Nov. 3, 2020

(54) RECREATIONAL DEVICE

(71) Applicant: KIDS INTERNATIONAL S.R.L., Milan (IT)

(72) Inventors: Debora Pietrobon, Milan (IT); Azra Jamous, Milan (IT); Benito De Sensi, Cernusco sul Naviglio (IT)

(73) Assignee: KIDS INTERNATIONAL S.R.L., Milan (IT)

( * ) Notice: Subject to any disclaimer, the term of this patent is extended or adjusted under 35 U.S.C. 154(b) by 0 days.

(21) Appl. No.: 16/480,980

(22) PCT Filed: Jan. 9, 2018

(86) PCT No.: PCT/IB2018/050122
§ 371 (c)(1),
(2) Date: Jul. 25, 2019

(87) PCT Pub. No.: WO2018/138589
PCT Pub. Date: Aug. 2, 2018

(65) Prior Publication Data

US 2020/0001193 A1 Jan. 2, 2020

(30) Foreign Application Priority Data

Jan. 27, 2017 (IT) ..... 102017000009230

(51) Int. Cl.
*A63H 17/02* (2006.01)
*A63H 17/26* (2006.01)
*A63H 17/00* (2006.01)

(52) U.S. Cl.
CPC ..... *A63H 17/002* (2013.01); *A63H 17/02* (2013.01); *A63H 17/262* (2013.01)

(58) Field of Classification Search
CPC ..... A63H 17/00; A63H 17/17; A63H 17/002; A63H 17/004; A63H 17/02; A63H 17/262; A63H 17/266
(Continued)

(56) References Cited

U.S. PATENT DOCUMENTS 2,757,482 A 8/1956 Brown et al.
5,248,274 A * 9/1993 Wang ..... A63H 37/00 446/435
5,713,783 A 2/1998 Szoke et al.

FOREIGN PATENT DOCUMENTS

FR 2 759 299 A1 8/1998
JP 50-139094 U 11/1975

* cited by examiner

*Primary Examiner* — Kien T Nguyen
(74) *Attorney, Agent, or Firm* — Vorys, Sater, Seymour, & Pease LLP

(57) ABSTRACT

Recreational device including support including first guide defining main axis, slider movably constrained to the support and movable along the main axis, at least one covering element configured to be detachably constrained to the support, elastic element constrained to the slider and to the support and acting between them along the main axis. The elastic element defines a rest configuration wherein it is in a rest position between slider and support and an operating configuration wherein slider and support are in contrast to the elastic element. The covering element includes at least a first interaction surface, the slider includes at least one component protruding outwards and defining at least a second interaction surface configured to interact with the first interaction surface, and the second interaction surface is configured to undo the connection between covering element and support when the elastic element is in operating configuration.

15 Claims, 3 Drawing Sheets

(58) Field of Classification Search
USPC ..... 446/4, 6, 69, 465, 470, 471
See application file for complete search history.

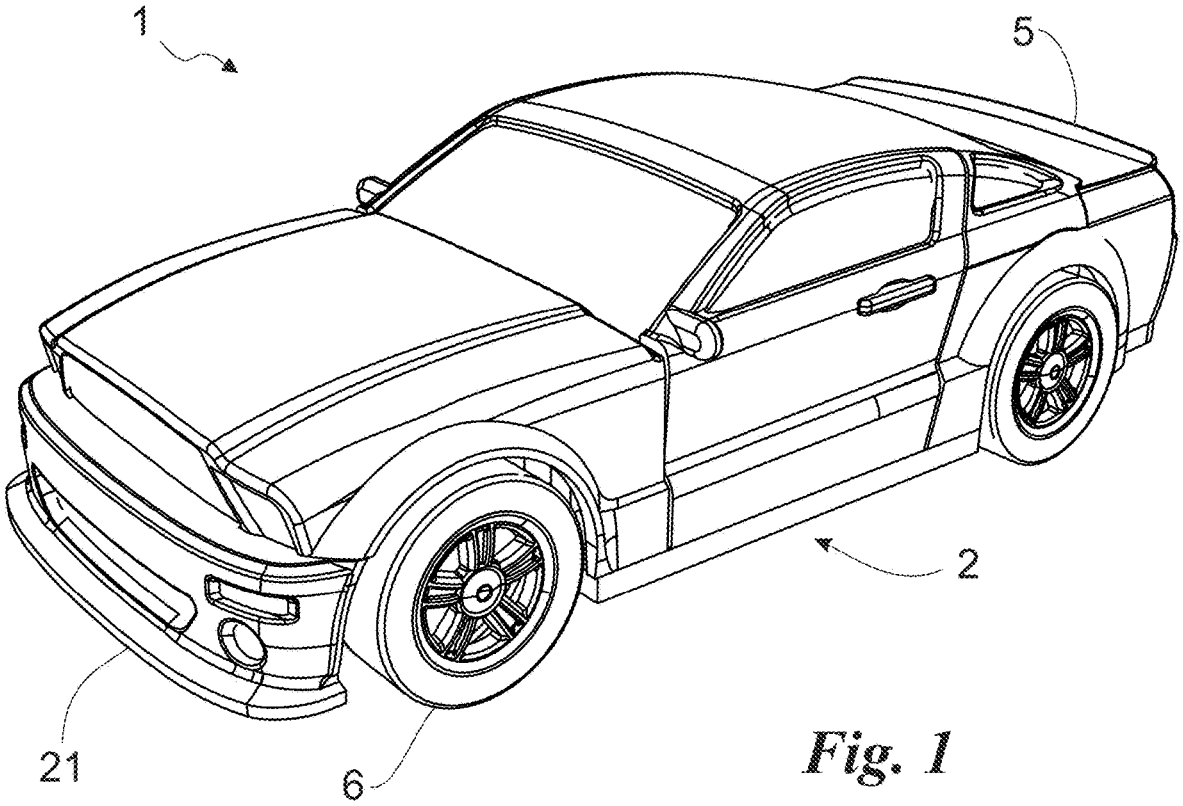
*Fig. 1*
*Fig. 4*
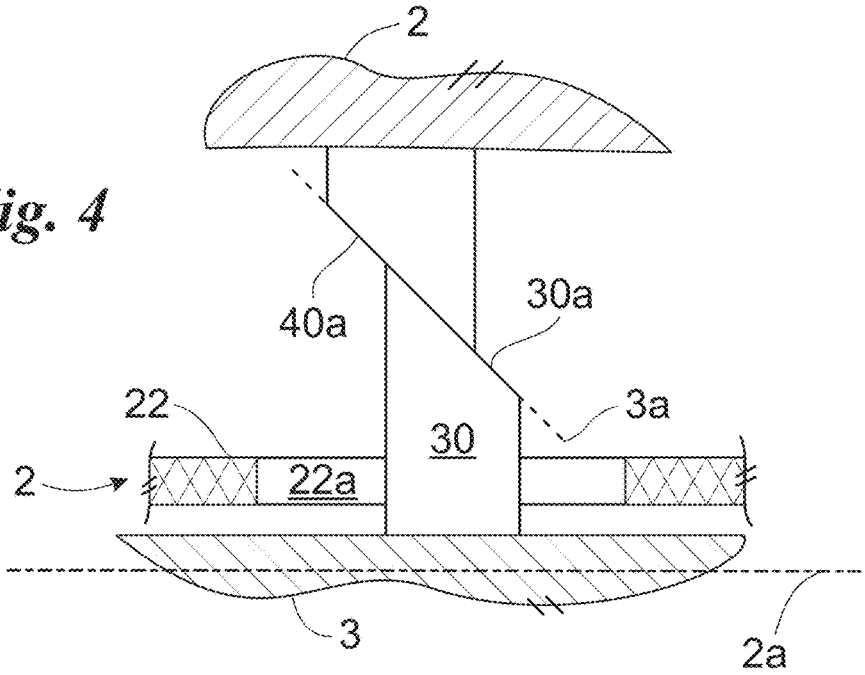

RECREATIONAL DEVICE

The present invention relates to a recreational device of the type as recited in the preamble of Claim 1.

Similar devices are described in the patent applications U.S. Pat. No. 2,757,482 and JPS-U-50139094.

In particular, the present invention relates to a recreational device mainly for children.

As known, recreational devices or toys for children are suitable for the entertainment and, sometimes, the education of the same.

There are various types of device on the market that also vary according to the users who they are targeted at, whether girls, boys or older children.

For example, stuffed toys, puzzles, video games, construction games, toy cars or miniature toy transport vehicles are present on the market In detail, among the construction toys LEGO® bricks have gained particular notoriety. These objects allow the user to construct, with the help of instructions or freely, objects of various types.

It is possible to make figures, machines, structures and monuments or any other recognizable and aesthetically distinct object.

LEGO® can be disassembled and reassembled at will by the user and with absolutely free and variable configurations without restriction.

Another example of toys known to children are the toy cars marketed by Hot Wheels® or Burago® or again, Tamiya®.

These cars have different designs and shapes, and in some cases, are also constructible. Especially in the case of Burago® they are designed to replicate for children the historic or modern cars typical of the adult world.

In the case of the toy cars Tamiya Mini 4WD®, it is also possible to construct the inner mechanisms of the car and to change the engines.

These devices are mostly used on tracks or, in general, for races or competitions between children.

The prior art described has several significant drawbacks.

In particular, the prior art takes into account only limited aspects relating to children's entertainment.

Especially among younger children, entertainment is related not only to the fact of being able to construct or modify a toy, but also to the possibility of being able to break it.

The devices listed, once broken, can no longer be used or need to be replaced since they are not designed for such activity.

Another aspect of the games listed above is that the purposes for which they have been designed are typically recreational and creative, but are lacking from an exclusively educational point of view.

Finally, with the exception of LEGO® bricks, the other devices are not easily customizable from an aesthetic point of view and may thus lead to a reduced longevity of the product considering that children often tend to be very demanding and vary the toys they use.

In this situation, the technical purpose of the present invention is to devise a recreational device able to substantially overcome at least some of the drawbacks mentioned.

Within the sphere of said technical purpose, one important aim of the invention is to obtain a recreational device which can be substantially broken without detracting from its functioning and which vice versa is actually designed to be taken apart.

Another important purpose of the invention is to make a recreational device, which is not only entertaining, but also educates children.

In conclusion a further purpose of the invention is to make a device the appearance of which can be changed by the user at will while keeping intact the characteristics of the device.

The technical purpose and specified aims are achieved by a recreational device as claimed in the appended claim 1. Examples of preferred embodiment are described in the dependent claims.

The characteristics and advantages of the invention will become evident by way of the following detailed description of preferred embodiments thereof, with reference to the accompanying drawings, in which:

FIG. 1 is a perspective view of the recreational device;

FIG. 4 is a detailed view of the surfaces of interaction between the covering element and slider component.

Figure 2:
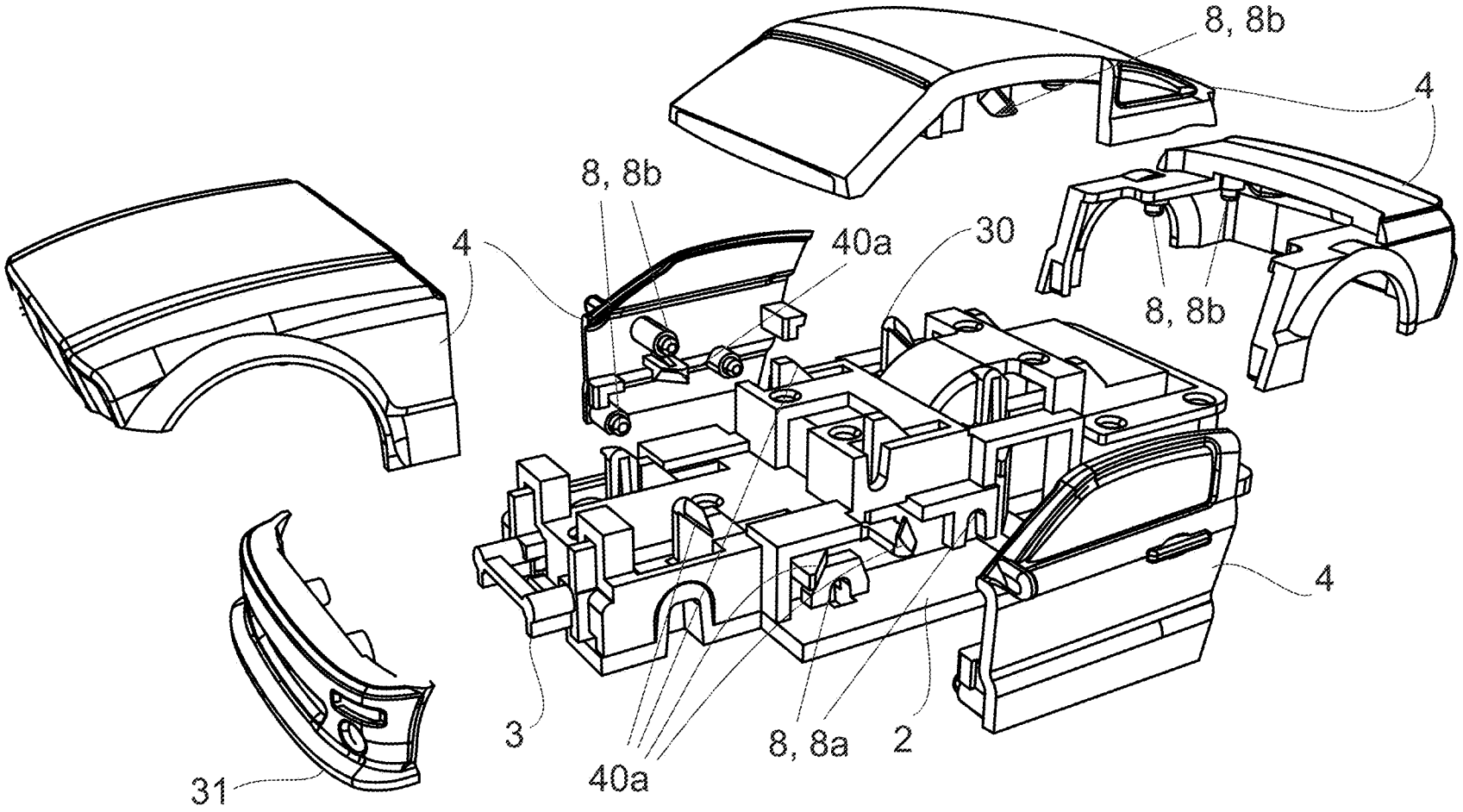
FIG. 2 is an exploded view of the recreational device.
Figure 3:
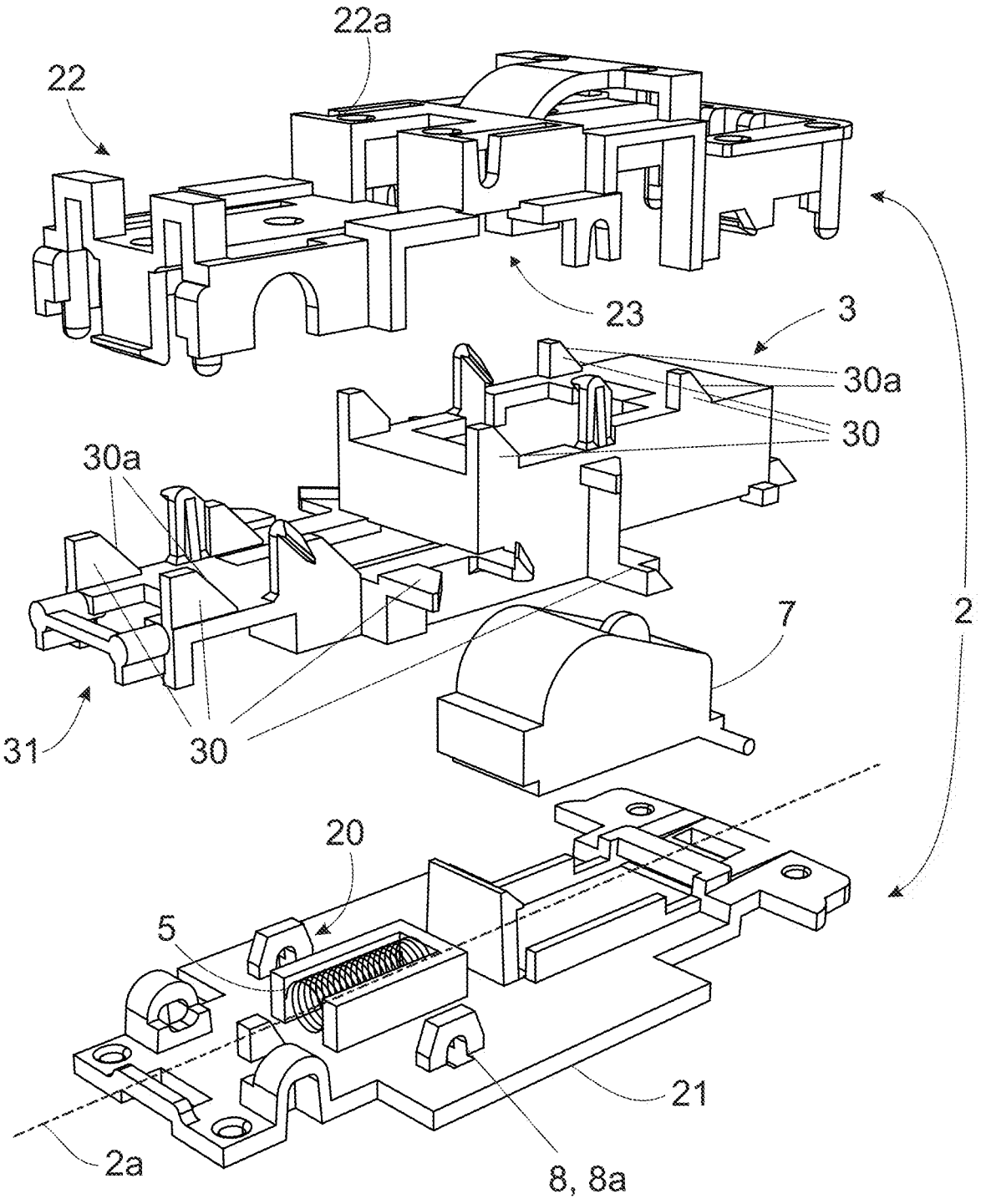
FIG. 3 is an exploded view of the internal structure of the recreational device.

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference which it is associated with. For example, said terms, if associated with a value, preferably indicate a divergence of not more than 10% of said value.

In addition, where used terms such as "first", "second", "upper", "lower", "main" and "secondary" do not necessarily refer to an order, a priority relationship or relative position, but may simply be used to more clearly distinguish different components from each other.

The measurements and data presented herein are to be considered, unless otherwise indicated, as made in Standard International Atmospheres ICAO (ISO 2533).

With reference to the Drawings, reference numeral 1 globally denotes the recreational device according to the invention.

The recreational device 1 is preferably a toy and, in particular, a model of a means of transport.

Therefore, it may be a wagon of a train, a plane, a motorcycle, or so forth. More specifically the device 1 is a model of a conventional car.

This model may in addition be of variable size and may replicate conventional cars according to scale, for example, 1:18, 1:24; or 1:43.

Models in scales different from those listed above are however also included. The recreational device 1 comprises a support 2, a slider 3, a covering element 4 and an elastic element 5.

The support 2 is preferably substantially a frame or chassis constituting, in the preferred embodiment, the skeleton of the model toy i.e. of the device 1.

The support 2 then comprises a first guide 20 defining a main axis 2*a*.

The first guide 20 is preferably a track or rail suitable to direct the movement of an object, such as for example a carriage or slider within an axis that preferably coincides with the main axis 2*a*.

The support 2 comprises then a bottom surface 21, an outer cover 22 and a cavity 23.

The bottom surface 21 is preferably the bottom of the support 2 and, for example, consists of a rigid plate defining the base of a model car and therefore presents the geometrical characteristics, to scale, of the bottom of a car.

The outer cover 22 is substantially preferably the upper part of the support 2. It is preferably a hollow cover, which can be connected above the bottom surface 21; in particular, the outer cover subtends the cavity 23.

The cavity 23 is therefore preferably defined as the empty space between the bottom surface 21 and the outer cover 22.

The outer cover 22 preferably does not entirely enclose the cavity, but comprises a plurality of openings on its surface.

In particular, the outer cover 22 comprises at least a second guide 22*a*. This second guide 22*a* is, for example, placed in the upper portion of the outer cover 22, but it can also be placed sideways. For example, in addition, a plurality of second guides 22*a* may be present suitable to house sliders inside them and, in detail, one or more sliders.

In addition, preferably, the outer cover 22 defines with the bottom surface 21 the first guide 20.

In particular, the lateral surfaces of the outer cover 22 constitute banks suitable to limit the area of movement inside the cavity 23 within the main axis 2*a*.

The bottom surface 21 and the outer cover may thus be in one piece, or, preferably, may be two separate parts that can be connected by interlocking.

The support 2 may be made of various materials. For example, it may be made of metal, rubber, wood or otherwise. Preferably, the support 2 is made of polymeric material.

The slider 3 is preferably an element suitable to move along a guide. Preferably, the slider 3 is suitable to move along the first guide 20 and is at least partially contained inside the cavity 23.

In addition, the slider 3 is preferably at least partially contained between the bottom surface 21 and the outer cover 22.

As a result, preferably, the slider 3 is substantially movably connected to the support 2 and mobile along the main axis 2*a*.

The support 2 and the slider 3 thus describe, for example, a sleeve structure. In addition, between the slider 3 and the support 2 the elastic element 5 is interposed.

The elastic element 5 in particular is constrained to the slider 3 and to the support 2 so that when the slider 3 is moved inside the support 2, it assists or opposes the movement of the slider 3.

The elastic element 5 preferably, therefore, acts along the main axis 2*a* and defines a rest configuration and an operating configuration.

In detail, in the rest configuration, the elastic element 5 is in the rest position between the slider 3 and the support 2. The term rest position refers to the position in which the elastic element 5 is stressed with minimum force as far as permitted by the structure.

In the operating configuration instead, preferably the slider 3 and the support 2 are in contrast with the elastic element 5. Consequently, the operating configuration corresponds substantially to the condition in which the elastic element undergoes a greater stress than in the rest position.

The elastic element 5 tends then to bring the device 1 into the rest configuration.

The elastic element 5 therefore may be a rubber element or a magnetic element and, preferably, is a spring of the axial type. Said axial spring in the rest configuration is unloaded or under little stress, while in the operating configuration it is compressed or expanded.

The elastic element 5 is preferably suitable to enable the slider 3 to return to the rest configuration from the operating configuration, automatically.

The slider 3 comprises then a contact area 31.

The contact area 31 is preferably a part of the slider 3 projecting from the support 2.

For example, the contact area 31 corresponds to the front of the slider 3.

This contact area 31 is therefore preferably constituted, in the preferred configuration, by the bumper of a model car.

It is preferably suitable to hit an obstacle in such a way that the elastic element 5 moves from the rest configuration to the operating configuration.

In particular, therefore, the contact area 31 is one of the ends of the slider 3 arranged along the main axis 2*a*.

The slider 3 further comprises, preferably, at least one protruding component 30. Said protruding component 30 is, for example, an element of an elongated shape protruding outwards. In particular, it looks like a small wedge protruding toward the outer cover 22.

Preferably, the component 30 is protruding outwards so as to protrude from the outer cover 22. Preferably, the component 30 is suitable to be housed, at least partially, inside second guides 22*a*.

Preferably the slider 3 comprises a plurality of components 30 and in particular in number from ten to thirty, for example sixteen, of which eight arranged in the upper part of the slider 3, and thus of the support 2, three on each lateral surface of the slider and thus of the support 2 and two placed at the rear.

The term rear, in the preferred configuration, means the back of the model car, while front clearly means the part that generally comprises the bonnet-engine.

Each component 30 defines a second interaction surface 30*a*.

This second interaction surface 30*a* is preferably suitable to come into contact with other objects.

Preferably, the second interaction surface 30*a* defines a sliding direction 3*a*. The sliding direction 3*a*, is for example, the direction of movement of the objects sliding on the second interaction surface 30*a*.

Preferably the sliding direction defines with the main axis 2*a* an angle between 30° and 60° and, more appropriately, between 40° and 50°.

The components 30 are preferably suitable to interact with one or more covering elements 4. The covering elements 4 are elements suitable to cover the structure defined by the support 2. In particular, in the preferred configuration, they consist of a complete body of a model car or a part of the bodywork of a model car.

For example, the covering element 4 may therefore be a door, a windscreen, a bonnet, detachably constrained to the support 2.

Preferably, the covering element or elements 4 can be detachably connected to the support 2. In particular, they are mutually detachably connected by coupling means 8. The latter are preferably of the known type, for example are pins 8*b*, preferably integral with the covering element 4, and seats 8*a*, preferably integral with the support 2 in which said pins 8*b* can be housed by interlocking. Said coupling means 8 preferably interlock by interference.

In addition, said covering element 4 comprises at least a first interaction surface 40*a*. Said first interaction surface 40*a* is suitable to interact for example with the components 30. In detail, the first interaction surface 40*a* interacts with a second interaction surface 30*a*.

The first interaction surface 40*a* and the second interaction surface 30*a* in particular interact with each other by interference when the elastic element 5 switches to the operating configuration, i.e. when the slider 3 is moved or translated and the components 30 slide within the second guides 22*a*.

Preferably, the second interaction surface 40*a* is suitable to undo the connection between the covering element 4 and the support 2 when the elastic element 5 is in the operating configuration.

In addition, preferably the first interaction surface 40*a* is counter-shaped to the second interaction surface 30*a*. Alternatively, the first interaction surface 40*a*, or the second 30*a* may simply be a smooth portion and disengage itself due to the wedge shape or mere interaction of the other portion.

Consequently, the interaction surface 40*a* also defines a direction coincidental or parallel to the sliding direction 3*a*.

Preferably, the first interaction surface 40*a* is suitable to slide on the second interaction surface 30*a* when the elastic element 5 is in the operating configuration. When the covering elements 4 are constrained to the support 2 in fact the first and second interaction surfaces 40*a*, 30*a* are preferably substantially in contact.

In the preferred embodiment, when the elastic element 5 is in the operating configuration, the covering element 4 moves perpendicular to the main axis 2*a* along the coupling means 8. As a result, the covering element 4 moves away from the support 2 and the detachable connections consisting of the coupling means 8 are released.

The device 1 further comprises blocking means (not shown in the drawing) suitable to block the movement between the support 2 and the slider 3 and to keep the elastic element 5 in said rest position. Said blocking means are composed for example of an interlocking insert insertable in the support 2 and suitable to block, for example by means of a perpendicular, and not inclined wall like the surfaces 30*a* and 40*a*, the mutual translation of the support 2 and the slider 3.

The device 1 therefore preferably comprises at least one movement member 6. It is preferably weakly constrained to the support 2 and is suitable to adhere at least partly to a support surface and to move the support 2 in relation to the support surface.

The support surface may thus be a floor, a table or other.

In particular the movement members 6 may be wheels or means suitable to allow the movement of the device 1 with respect to a plane, or in any case, a support surface.

Preferably, the movement member 6 is a wheel and four movement members 6 are movably constrained to the support 2.

The device 1 further comprises at least one locomotive apparatus 7.

The locomotive apparatus 7 is for example suitable to move one or more movement members 6.

Preferably, the locomotive apparatus 7 is a pullback system of the known type.

Consequently, the locomotive apparatus 7 is constrained to the support 2 and sets the movement members in motion when operated by a user.

In particular, in the preferred configuration, the locomotive apparatus 7 is recharged when the device 1 is made to reverse by a user. Once the device 1 is freed, the locomotive apparatus 7 moves the movement members 6 by pushing the device 1.

This operation is of the known type.

The functioning of the recreational device 1 described above in structural terms, is as follows.

The device can be operated by a user in a conventional manner, namely by using the pullback system known of in the prior art.

The device 1 is set into motion and when it meets an obstacle placed in front of it in relation to the forward direction, it pressurises the contact area 31.

As a result, the slider 3 moves rearwards undoing the connections of the covering elements 4 which are driven away from the support 2 and thus from the device 1. This way, in the preferred configuration, the car consisting of the device 1 loses body parts after a collision with an obstacle.

The recreational device 1 according to the invention achieves important advantages. In fact, the device makes it possible to simulate breakage without its functioning being adversely affected. As a result, the device makes it possible to entertain a non-adult public, which, as known, often finds amusement in taking apart or breaking objects.

In addition, this type of device makes it possible to create, should one wish, a road traffic simulation system for educational purposes.

For example, a model of an intersection may be recreated and, using a plurality of devices 1, the effect of rash or incorrect manoeuvres can be explained to children simulating the extent of the accident.

Another advantage of the device is that the pieces, namely the covering elements 4 are interchangeable.

In fact, various similar covering elements 4 may be provided (i.e. relative to the same portion of device) which include the same first interaction surfaces 40*a* and the same coupling means 8 so that they are interchangeable and different externally, for example in colour and/or shape. Several devices 1 may also be provided having identical interaction surfaces 30*a*, 40*a* and coupling means 8 and different externally, so that the covering elements 4 are interchangeable.

It is in fact possible to create sets of different colours or shapes allowing children to modify the device 1 at will without affecting its operation.

Variations may be made to the invention described herein without departing from the scope of the inventive concept defined in the claims.

For example, as already mentioned, the device may replicate a model other than a car. For example, there may be two movement members 6 and the device 1 may be a model bike. Alternatively, the position of the contact zone 31 may be varied. Alternatively, a plurality of elastic elements 5 and/or sliders 3 may be provided in such a way as to allow the collision to be seen on several sides at once.

In said sphere all the details may be replaced with equivalent elements and the materials, shapes and dimensions may be as desired.

The invention claimed is:

1. A recreational device comprising:

a support comprising a first guide defining a main axis, a slider movably coupled to said support and movable along said main axis, at least a covering element configured to be detachably connected to said support, an elastic element connected to said slider and said support and acting between said slider and said support along said main axis, said elastic element defining:

a rest configuration in which said elastic element is in the rest position between said slider and said support, an operating configuration in which said slider and said support are in contrast with said elastic element, and said device wherein said covering element comprises at least a first interaction surface, said slider comprises at least one component protruding outwards and defining at least a second interaction surface configured to interact with said first interaction surface defining a mutual sliding direction, said sliding direction defining with said main axis an oblique angle, said interaction between said interaction surfaces being configured to undo said constraint between said covering element and said support distancing said covering element from said support, when said elastic element is in the operating configuration.

2. The device according to claim 1, wherein said sliding direction defines with said main axis an angle comprised between 30° and 60° and allowing said first interaction surface to slide on said second interaction surface when said elastic element is in said operating configuration.

3. The device according to claim 1, wherein said covering element moves perpendicularly to said main axis when said elastic element is in said operating configuration.

4. The device according to claim 1, comprising means of constraint configured to detachably constrain said covering elements to said support.

5. The device according to claim 4, wherein said means of constraint are interlocking.

6. The device according to claim 1, comprising a plurality of similar covering elements, each comprising identical coupling means and identical first interaction surfaces, so that said plurality of covering elements is interchangeable.

7. The device according to claim 1, in which said support defines a bottom surface, an outer cover and a cavity, said cavity including said first guide and being suitable configured to house said slider and said outer cover comprising at least a second guide configured to house said at least one component.

8. The device according to claim 1, comprising at least one movement member weakly connected to said support, said movement member being configured to adhere at least partially to a support surface and to move said support with respect to said support surface.

9. The device according to claim 1, wherein said slider comprises a contact zone substantially consisting of a bumper and said device is configured to strike an obstacle in such a way that said elastic element passes from said rest configuration to said operating configuration.

10. The device according to claim 1, comprising blocking means configured to block the movement between said support and said slider with said elastic element in said rest position.

11. The set of recreational devices comprising a plurality of devices according to claim 1, wherein each of said recreational devices comprises similar covering elements, each comprising identical coupling means and identical interaction surfaces, so that said covering elements are interchangeable.

12. The device according to claim 2, wherein said covering element moves perpendicularly to said main axis when said elastic element is in said operating configuration.

13. The device according to claim 12, comprising means of constraint configured to detachably constrain said covering elements to said support.

14. The device according to claim 13, wherein said means of constraint are interlocking.

15. The device according to claim 14, comprising a plurality of similar covering elements, each comprising identical coupling means and identical first interaction surfaces, so that said plurality of covering elements is interchangeable.

* * * * *